US011133608B2

(12) United States Patent
Szelag et al.

(10) Patent No.: US 11,133,608 B2
(45) Date of Patent: Sep. 28, 2021

(54) CONTACT MEMBER FOR AN IDC TERMINAL, CONTACT MEMBER ASSEMBLY, SET OF CONTACT MEMBERS AND HOUSING COMPRISING A CONTACT MEMBER

(71) Applicant: TE Connectivity Germany GmbH, Bensheim (DE)

(72) Inventors: Martin Szelag, Bickenbach (DE); Guenter Feldmeier, Lorsch (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/797,431

(22) Filed: Feb. 21, 2020

(65) Prior Publication Data

US 2020/0274259 A1 Aug. 27, 2020

(30) Foreign Application Priority Data

Feb. 21, 2019 (EP) ..... 19158540

(51) Int. Cl.
*H01R 4/2433* (2018.01)
*H01R 12/57* (2011.01)
*H01R 12/58* (2011.01)

(52) U.S. Cl.
CPC ..... *H01R 4/2433* (2013.01); *H01R 12/57* (2013.01); *H01R 12/585* (2013.01)

(58) Field of Classification Search
CPC .. H01R 4/2429; H01R 4/2425; H01R 4/2433; H01R 4/2404; H01R 12/57; H01R 12/585
USPC ..... 439/395, 404, 405, 417
See application file for complete search history.

(56) References Cited

U.S. PATENT DOCUMENTS 3,866,297 A 2/1975 Aldridge et al.
4,552,429 A 11/1985 van Alst
8,702,442 B2 * 4/2014 Debenedictis ..... H01R 4/2429 439/395

FOREIGN PATENT DOCUMENTS

EP 3467942 A2 4/2019
GB 2034538 A 6/1980
WO 2017212097 A2 12/2017

OTHER PUBLICATIONS

European Search Report, Application No. 19158540.5, dated Aug. 1, 2019, 7 pages.

* cited by examiner

*Primary Examiner* — Gary F Paumen
(74) *Attorney, Agent, or Firm* — Barley Snyder

(57) ABSTRACT

A contact member for an insulation displacement contact (IDC) terminal includes an encasement wall at least partially surrounding a receptacle volume receiving a wire or cable, an IDC member having an IDC blade penetrating an insulation of the wire or cable and a contact edge electrically contacting a core of the wire or cable, and a cutting blade cutting the wire or cable. The receptacle volume has an opening at least partially framed by the encasement wall. The IDC member is formed in a first wall section of the encasement wall. The cutting blade is formed in a second wall section of the encasement wall opposite the first wall section. Both the IDC blade and the cutting blade face the opening.

20 Claims, 9 Drawing Sheets

CONTACT MEMBER FOR AN IDC TERMINAL, CONTACT MEMBER ASSEMBLY, SET OF CONTACT MEMBERS AND HOUSING COMPRISING A CONTACT MEMBER

CROSS-REFERENCE TO RELATED APPLICATION

This application claims the benefit of the filing date under 35 U.S.C. § 119(a)-(d) of European Patent Application No. 19158540.5, filed on Feb. 21, 2019.

FIELD OF THE INVENTION

The present invention relates to a contact member and, more particularly, to a contact member for an insulation displacement contact (IDC) terminal.

BACKGROUND

Contact members and insulation displacement contacts (IDC) generally require the application of specialized tools as well as a trained person for installation. Further, a necessary strength and mechanical resistance of the contact member contradicts the desire for miniaturization of the contact members.

SUMMARY

A contact member for an insulation displacement contact (IDC) terminal includes an encasement wall at least partially surrounding a receptacle volume receiving a wire or cable, an IDC member having an IDC blade penetrating an insulation of the wire or cable and a contact edge electrically contacting a core of the wire or cable, and a cutting blade cutting the wire or cable. The receptacle volume has an opening at least partially framed by the encasement wall. The IDC member is formed in a first wall section of the encasement wall. The cutting blade is formed in a second wall section of the encasement wall opposite the first wall section. Both the IDC blade and the cutting blade face the opening.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
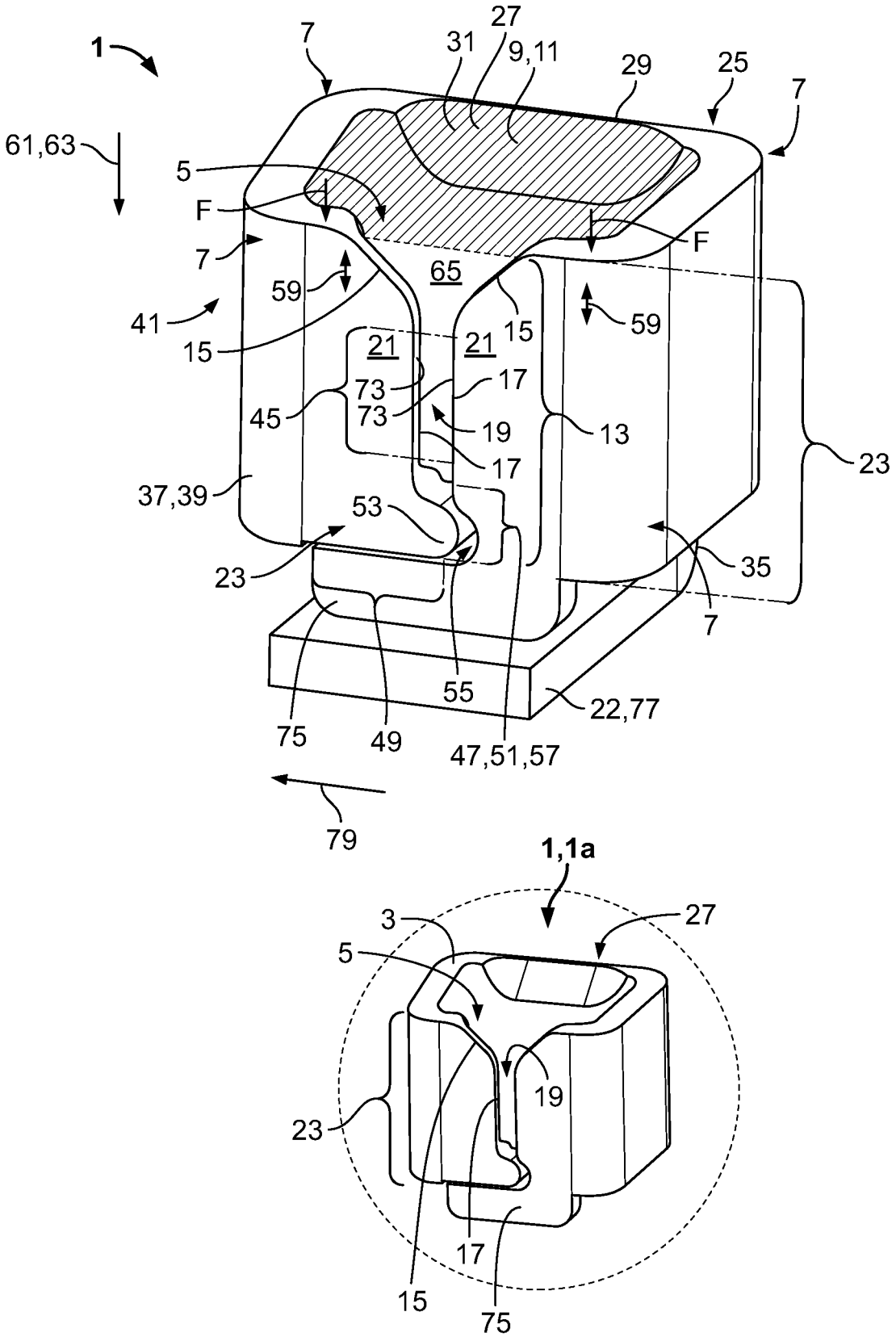
FIG. 1 is a front perspective view of a contact member and an alternative contact member according to various embodiments.

In the following, the present invention will be further described by specific embodiments shown in the accompanying figures. In the figures, specific embodiments are shown which do not limit the scope of protection which is provided by the claims. Different embodiments may comprise different technical features which may be arbitrarily combined with each other. In the figures, the same technical features and technical features with the same technical function are denoted with the same reference numeral. A repetitive description of aspects of the figures will be avoided, wherein differences between technical features of the figures will be emphasized.

Figure 2:
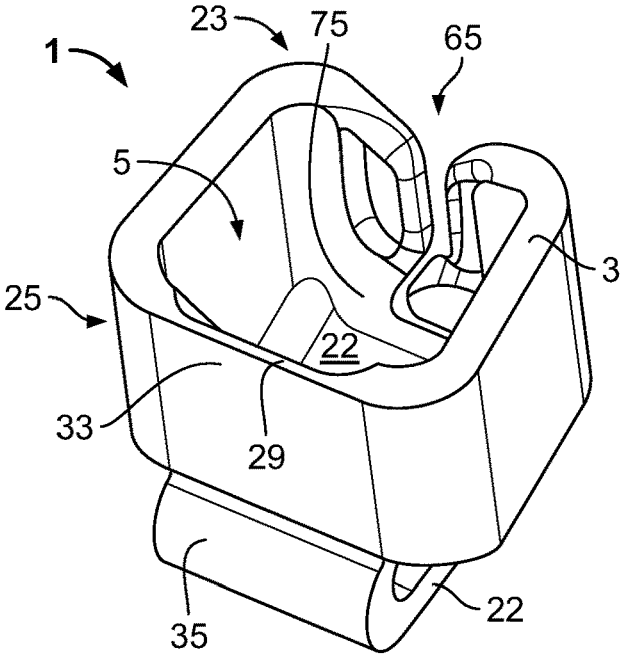
FIG. 2 is a top perspective view of the contact member.
Figure 3:
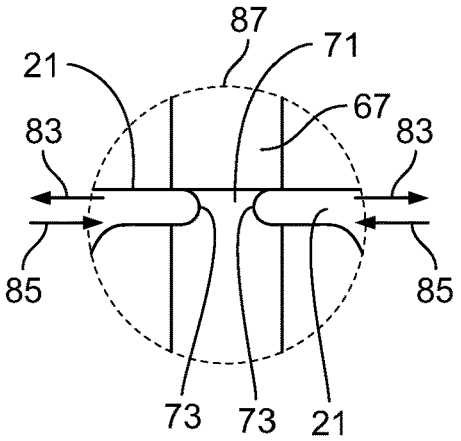
FIG. 3 is a top view of the contact member.
Figure 3:
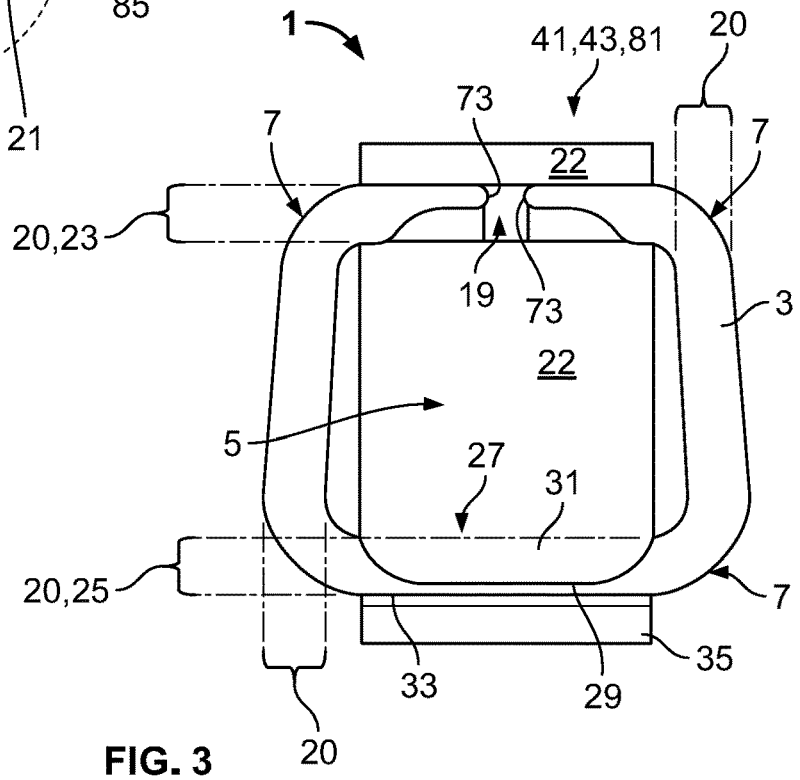

A contact member 1 according to an embodiment is shown in FIGS. 1-3. The contact member 1 comprises an encasement wall 3, which partially surrounds a receptacle volume 5. The encasement wall 3, which in the embodiment shown has four encasement bends 7, forms or defines the receptacle volume 5. The contact member 1 is configured to be applied in an insulation displacement contact (IDC) terminal, which will be described with reference to FIGS. 17-21. In an embodiment, the contact member 1 has a footprint of 2 mm×2 mm and a height of approximately 2 mm.

The receptacle volume 5 has an opening 9, as shown in FIG. 1, which is at least partially framed by the encasement wall 3. The opening 9 may be referred to as a (virtual) limiting surface of the receptacle volume 5. The opening 9 is indicated by a shading 11 in FIG. 1, which does not represent a real surface but rather a virtual plane. Sections of the opening 9, which are not framed by the encasement wall 3, are indicated with a dashed line.

The encasement wall 3 bent at the bends 7 may define a bending plane parallel to the shading 11 of the opening 9. An axis around which the encasement wall 3 is bent may be oriented perpendicular to the bending plane.

The contact member 1 comprises an IDC member 13, as shown in FIG. 1, that has a pair of IDC blades 15 and a pair of contact edges 17. In other embodiments, the IDC member 13 has at least one IDC blade 15 and at least one contact edge 17. In the embodiment shown in FIG. 1, the two IDC blades 15 and the two contact edges 17 oppose each other and are symmetrically arranged with respect to a slot 19. The slot 19 extends from the IDC blades 15 towards a bottom portion 22, and the slot 19 separates a pair of end portions 21 of the encasement wall 3 folded around the receptacle volume 5.

The IDC member 13, including the at least one IDC blade 15 and the at least one contact edge 17, is formed in a first wall section 23 of the encasement wall 3, as shown in FIGS. 1-3. In the embodiment shown, the contact member 1, or the encasement wall 3, has four wall sections 20.

Opposite the first wall section 23 with respect to the receptacle volume 5, a second wall section 25 is provided in the encasement wall 3, as shown in FIGS. 1-3. In the second wall section 25, a cutting blade 27 is formed, which has a cutting edge 29 and a blade surface 31. The cutting edge 29 is provided or embodied at an outer surface 33 of the encasement wall 3. In the shown embodiment, the cutting blade 27 is monolithically formed in the second wall section 25 of the encasement wall 3. In other embodiments, a separate blade may be inserted into the contact member 1. The cutting blade 27 may be processed, i.e. hardened or provided with coatings facilitating cutting through a wire or cable.

In FIG. 1, an alternative embodiment 1*a* of the contact member 1 is shown, which is identical to the contact member 1 of FIGS. 1-3, except that the alternative embodiment 1*a* does not comprise a bottom portion 22. Technical features which will be shown in the subsequent figures and which do not require the bottom portion 22 may also be provided at the alternative embodiment 1*a* of the inventive contact member 1.

The bottom portion 22, in the embodiment shown in FIGS. 1 and 2, is oriented essentially perpendicular to the encasement wall 3, and essentially parallel to the opening 9, wherein the bottom portion 22 and the opening 9 are located on opposite sides of the receptacle volume 5; they thus oppose each other. The bottom portion 22 may at least partially close the receptacle volume 5. The bottom portion 22 may thus prevent access to the receptacle volume 5 or entirely close the receptacle volume 5 from this side of the contact member 1.

The bottom portion 22 is connected with the second wall section 25 via a bent section 35, in a monolithic manner in an embodiment. The contact member 1 shown in FIG. 1 is formed from a sheet metal 37, which is stamped and bent into a sheet metal part 39. The bent section 35 may, in an embodiment, if seen in a direction from the receptacle volume 5 to the outside of the contact member 1, extend beyond the outer side 33 of the encasement wall 3.

The contact member 1 has an essentially cuboid shape 41 as shown in FIG. 1, wherein minor deviations from right angles of the cuboid shape 41 are, within this disclosure, referred to as being cuboid as well. A minor tapered shape 43 as shown in FIG. 3 is therefore still considered being a cuboid shape 41.

The slot 19 has a section 45, as shown in FIG. 1, which is oriented perpendicular to the bottom portion 22, respectively to the opening 9. Section 45 may be referred to as perpendicular section 45. The slot 19 has a bent section, which, in order to avoid any ambiguity with the bent section 35 that connects the second wall section 25 and the bottom portion 22, will be referred to as bent slot section 47.

The slot 19 has a section 49 that is oriented parallel to the bottom section 22 as shown in FIG. 1, respectively parallel to the opening 9, and that is referred to as parallel section 49. The bent slot section 47 of the slot 19 has an arc section 51 that is bent away from the perpendicular section 45 of the slot 19. The arc section 51 is located between the perpendicular section 45 and the parallel section 49 and connects both. By such an orientation, a force exerted from the wire received in the contact member 1 may be redirected in a direction parallel to the bottom portion 22. A torsional movement of the contact member 1 may therefore be avoided.

The slot 19 width may change, i.e. be different in the different portions of the slot 19. The slot 19 width may for instance be decreased in the arc section 51 to a slot width 19 of essentially zero in the section 49 of the slot 19 oriented parallel to the bottom portion 22.

In the arc section 51, one end portion 21 of the encasement wall 3 has a protrusion 53 which is received in a complementary formed recess 55 of the opposing end portion 21, as shown in FIG. 1. In the arc section 51, the protrusion 53 and the recess 55 therefore engage in a form fit 57. The form fit 57 prevents a relative movement 59 of either of the end sections 21 relative to each other along a direction 61, also an insertion direction 63 that is perpendicular to the opening 9.

Opposing the arc section 51, the slot 19 opens out into a tapered funnel 65, as shown in FIGS. 1 and 2, which is formed by the two IDC blades 15 in the first wall section 23. The tapered funnel 65 facilitates positioning of a cable or wire 67, as shown FIGS. 4 and 5. The tapered funnel 65 penetrates an insulation 69 of the wire 67 (in the following the term wire relates to wire and cable) with the IDC blades 15, wherein the tapered funnel 65 positions the wire 67 with respect to the slot 19, and a core 71 of the wire 67 is aligned with the slot 19 if viewed along the insertion direction 63. By such an alignment, a damage of the core 71 of the wire 67 by the IDC blades 15 may be prevented. The contact edges 17 of the slot 19 may further comprise rounded edges 73 shown in FIG. 1 facing towards the slot 19, which also prevent a damage of the core 71 of the wire 67.

The contact member 1 further comprises a support member 75, shown in FIG. 1, provided between the first wall section 23 and the bottom portion 22. In the alternative embodiment 1*a* the support member 75 is provided further in the insertion direction 63 than the first wall section 23. With the support member 75, the bottom portion 22 provides a stop 77 for the first wall section 23 if a force F is exerted onto the first wall section 23 in the direction 61 from the opening 9 towards the support member, respectively towards the bottom portion 22. Independent of whether the force F is exerted on one end portion 21 of the encasement wall 3 or on the other end portion 21, the force F is transmitted to the bottom portion 22 via the support member 75. The bottom portion 22 may therefore support the encasement wall 3 and increase the mechanical stability of the entire contact member 1.

Even in the alternative embodiment 1*a*, such a force F is transmitted via the support member 75, wherein in contrast to embodiments comprising the bottom portion 22, a further force receiving member (not shown) is applied and acts as a stop 77.

The support member 75 is formed by one end portion 21 of the encasement wall 3, the corresponding end portion 21 of the encasement wall 3 extends into the insertion direction 63 and further into a side direction 79, as shown in FIG. 1. Thus, the support member 75 is essentially oriented parallel to the opening 9 and/or to the bottom portion 22. The support member 75 is located adjacent to the end portion 21, which does not form the support member 75, such that the support member 75 is at least partially located between the end portion 21 and the bottom portion 22. If seen along the insertion direction 63, parts of the support member 75 therefore extend behind the end portion 21, which does not form the support member 75.

As shown in FIG. 3, in a relaxed state 81 the contact member 1 has a tapered shape 43. When a core 71 of the wire 67 is pressed into the slot 19, the rounded edges 73 contact the core 71, wherein the core 71 resiliently deflects the end portions 21 of the encasement wall 3 linearly in an outward direction 83. Accordingly, a contact force 85 is exerted from the end portions 21 onto the core 71 of the wire 67. The forces are exerted symmetrically from both sides onto the core 71. Thus, the core 71 of the wire 67 is contacted, wherein no component of a force is directed out of the slot 19. In other words, once the core 71 of the wire 69 is received in the slot 19 it is held therein in a fixed manner and not pushed out of the slot 19. The situation is shown in a circle 87 in FIG. 3.

Due to the linear movement in the outward direction 83, the contact member 1 provides an even and constant increase of necessary space occupied by the contact member 1 along a direction essentially parallel to the slot 19. In comparison to prior art solutions, the contact member 1 thus requires less installation space.

The support member 75 may assist the linear movement of the end portions 21 away from each other; a shearing or tilting movement may be prevented by abutment or support portions for the end portions 21, wherein the abutment or support portions or points, both abut the support member 75 and are both located at a distance to each other. The support member 75, which may be provided at a first end section thus may abut a second end section, at least at two positions located at a distance to each other, wherein the second end section abuts the support member 75. Thus, by the at least two support points a shearing movement of either of the end portions 21 may be reduced or even prevented. Further, the encasement bends 7 may provide further increase of the stiffness of the contact member 1 against a shearing movement of the end portions 21.

In the relaxed state 81, i.e. without any force acting on the contact member 1, the support member 75 may be positioned in the vicinity of the bottom portion 22, without abutting it. In a different embodiment, the support member 75 may abut the bottom portion 22 already in the relaxed state 81. As soon as a force acting on the contact member 1 in a direction towards the bottom portion 22 is applied, the force is transmitted via at least the first wall section 23 onto the support member 75, which is thereby brought into abutment with the bottom portion 22. A force is thus exerted on the bottom portion 22 as well.

In the end portions 21 of the encasement wall 3, a wall thickness may be reduced in order to prevent a squeezing of the insulation of the wire 69 along a longitudinal direction of the wire 69. A certain displacement of the insulation of the wire 69 over a distance corresponding to the thickness of the contact edge 17 may occur in any case, wherein the distance of displacement is smaller than the thickness of the encasement wall 3. Such a thinned portion may correspond to the shape, i.e. the radius of the wire 69 to be contacted by the contact member 1.

In an embodiment of the contact member 1, the tapered shape 43 may be predetermined such that upon receipt of a core 71 of a wire 67 of a predetermined diameter, the deflection of the end portions 21 in the outward direction 83 may result in a rectangular structure, the taper may represent a pre-form turning into a rectangle after correct installation of the core 71 of the wire 67.

Figure 4:
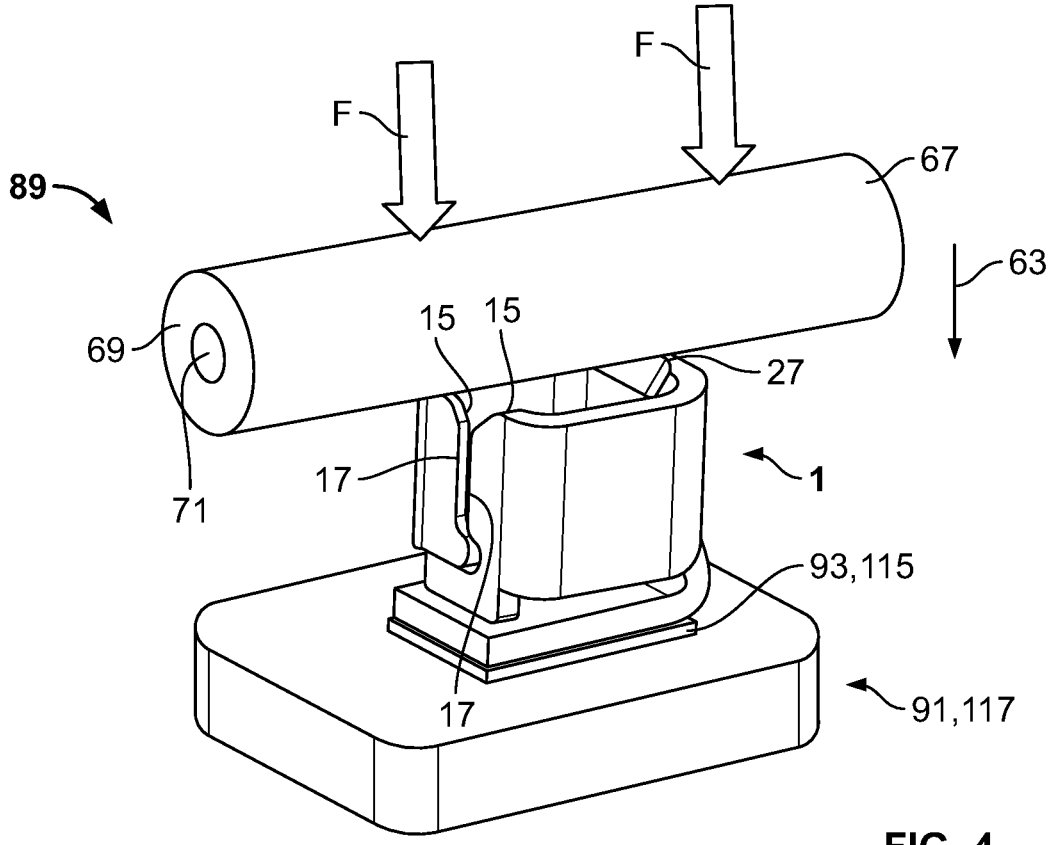
FIG. 4 is a perspective view of a contact member assembly prior to insertion of a wire.
Figure 5:
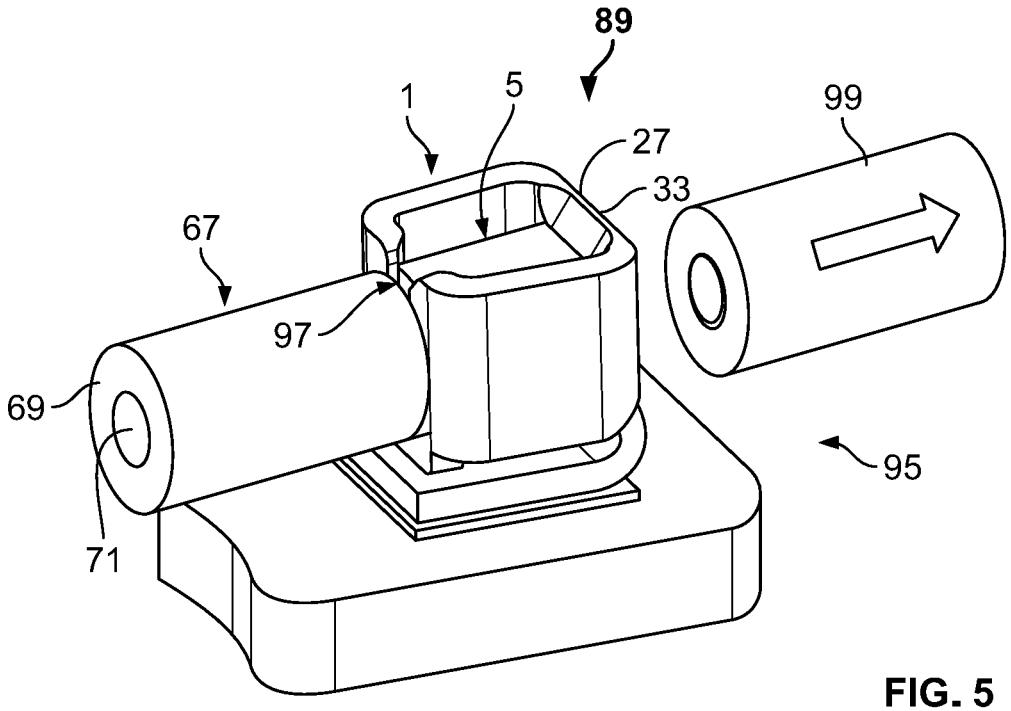
FIG. 5 is a perspective view of the contact member assembly with the wire in a connected state.
Figure 6:
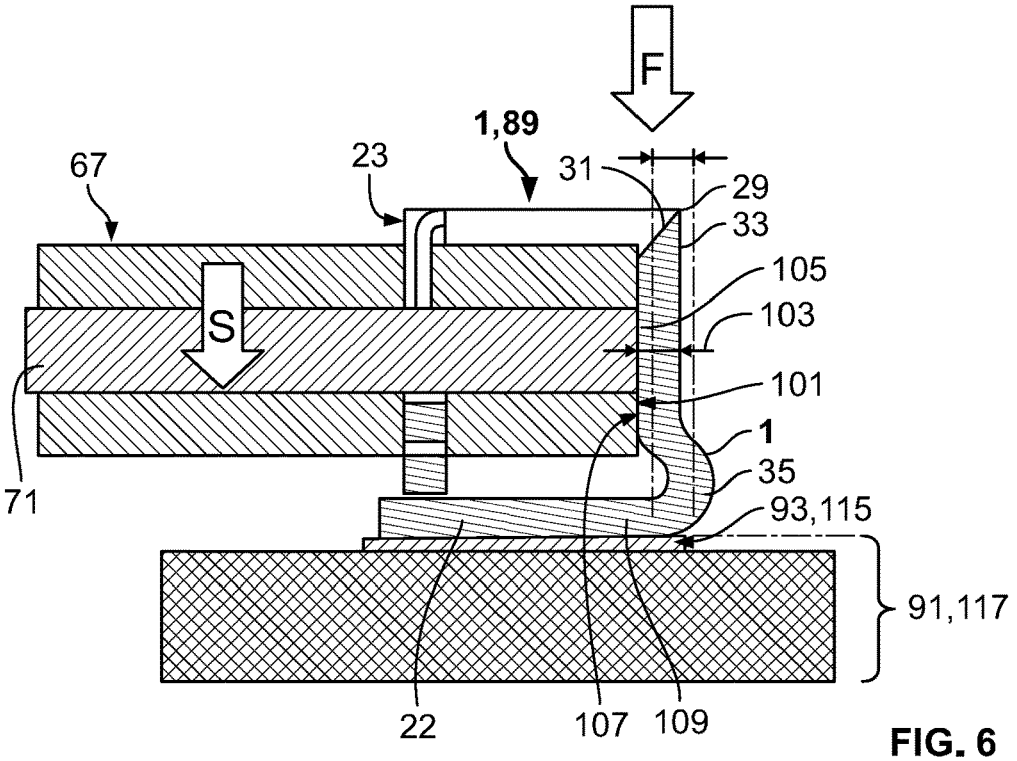
FIG. 6 is a sectional side view of the contact member assembly with the wire in the connected state.
Figure 7:
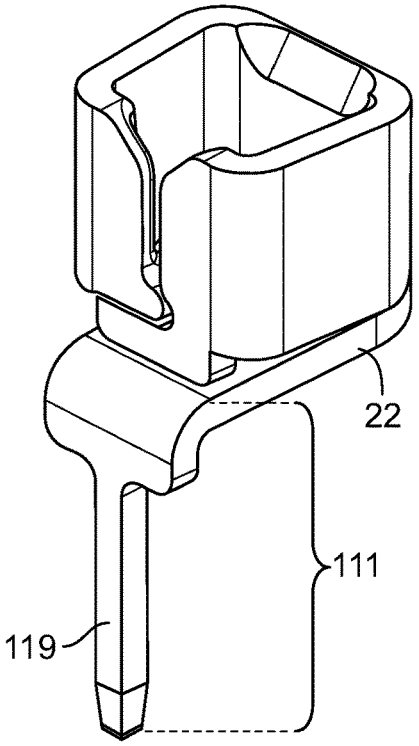
FIG. 7 is a perspective view of a contact member with a functional section according to an embodiment.
Figure 8:
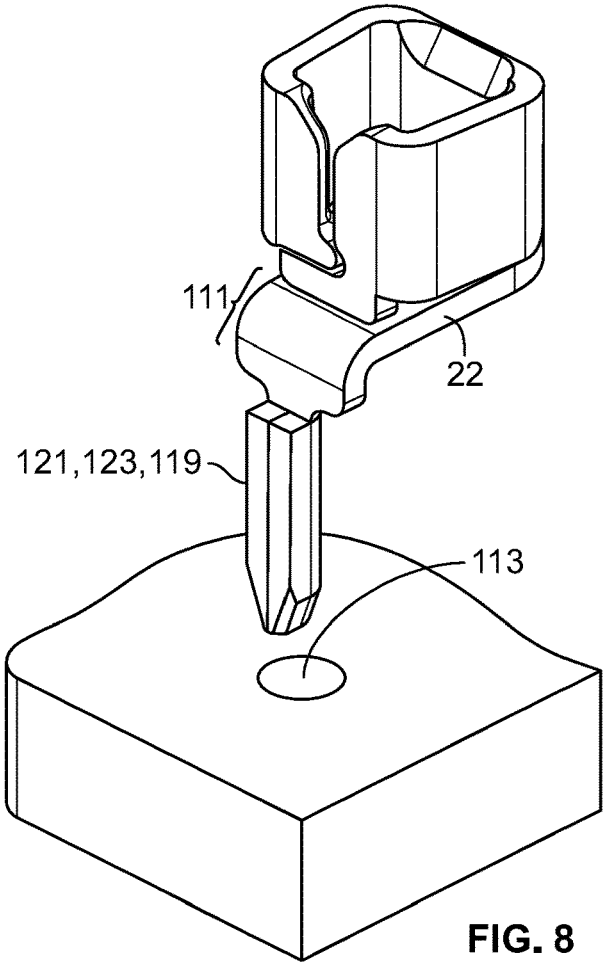
FIG. 8 is a perspective view of a contact member with a functional section according to another embodiment.
Figure 9:
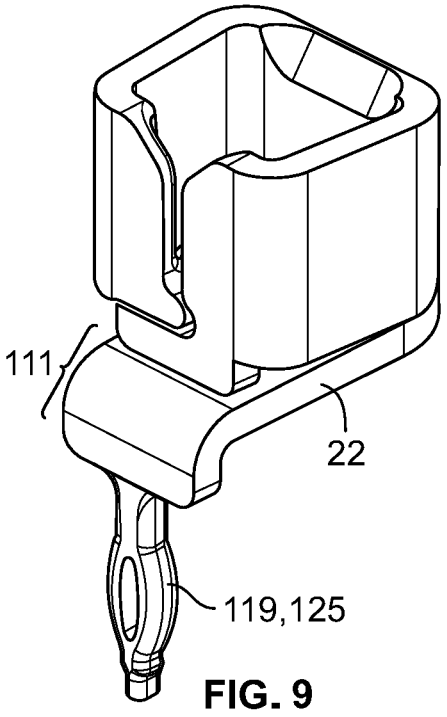
FIG. 9 is a perspective view of a contact member with a functional section according to another embodiment.
Figure 10:
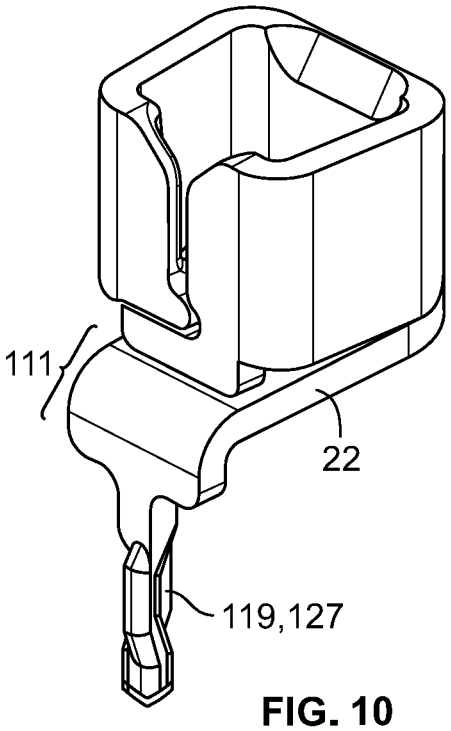
FIG. 10 is a perspective view of a contact member with a functional section according to another embodiment.
Figure 11:
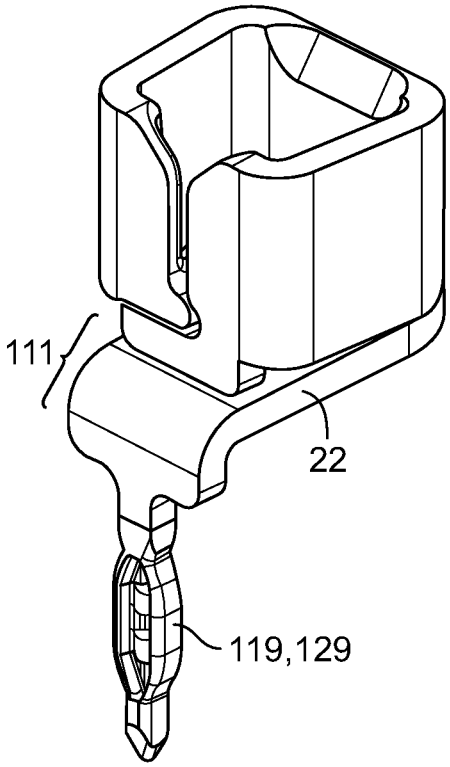
FIG. 11 is a perspective view of a contact member with a functional section according to another embodiment.
Figure 12:
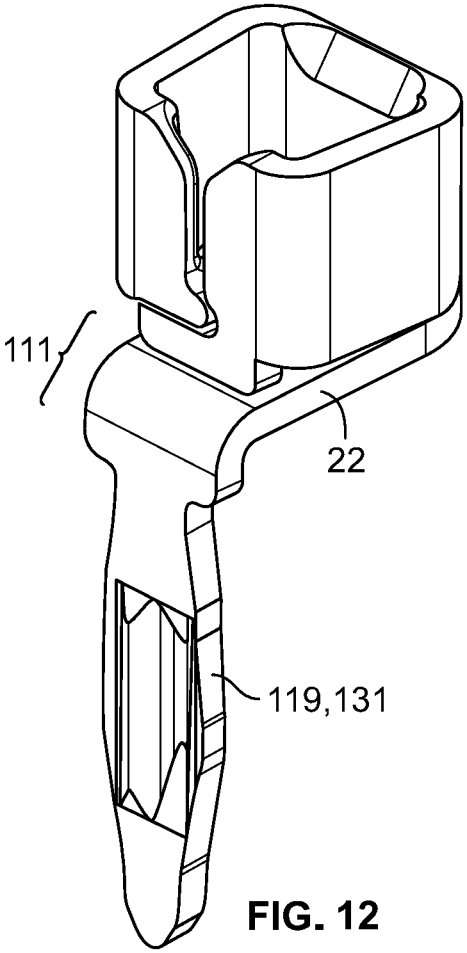
FIG. 12 is a perspective view of a contact member with a functional section according to another embodiment.

A contact member assembly 89 according to an embodiment is shown in FIGS. 4-6. The contact member assembly 89 includes the contact member 1 and a mating contact element 91. The contact member 1 is electrically connected to the mating contact element 91. In the embodiment shown, the electric connection is performed via a contact pad 93.

In FIG. 4, the insulation of a wire 67 is shown. The wire 67 is pressed via a force F in the insertion direction 63. By doing so, the IDC blades 15 penetrate the insulation 69 of the wire 67 and the cutting blade 27 will cut the entire wire 67. A contacted state 95 is shown in FIG. 5. Here, the insulation 69 is cut and displaced in a displacement portion 97 such that the contact edges 17 (not shown in FIG. 5, see FIG. 4) contact the core 71 that is exposed by cutting and displacing the insulation 69 in the displacement portion 97. At the cutting blade 27, the wire 67 is cut and a residual piece of the wire 99 may be removed. When the wire 67 is moved into the receptacle volume 5, cutting occurs at the outer side 33 outer surface 33 of the contact member 1, wherein the cut surface 101 slides along the blade surface 31 and is displaced via a wall thickness 103 towards the first wall section 23. The core 71 of the wire 67 therefore forms a third contact point 105 and an inner surface 107 of the encasement wall 3. The first and second contact points are not shown but they are formed by the two contact edges 17 contacting the core 71 of the wire 67.

FIG. 6 shows that a force F exerted onto the contact member 1 by inserting the wire 67 is transmitted towards the bottom portion 22 in a straight portion 109 of the bottom portion 22 and not towards the bent section 35, which would result in an unstable positioning of the contact member 3 on the contact pad 93.

In the embodiment shown in FIGS. 4-6, the contact member 1 is directly connected to the mating contact element 91 via the bottom portion 22. Different devices for contacting the mating contact element 91 are described with reference to the following FIGS. 7-16.

In FIGS. 7-12, the contact member 1 has a functional section 111. In the embodiment shown, the bottom portion 22 is extended to form the functional section 111, such as by stamping and bending a sheet metal part. The functional section 111 is configured to be plugged in a mating plug receptacle 113 and/or for being electrically connected to a mating contact section 115 of a mating contact member 117. The mating plug receptacle 113 is exemplarily shown in FIG. 8 and the mating contact section 115 of the mating contact member 117 is each shown in FIGS. 13 and 15. The previously described mating contact element 91 and the contact pad 93 may be considered being a mating contact member 117 and a mating contact section 115, respectively, as well.

In the embodiments shown in FIGS. 13-16, the electrical connection is established between the functional section 111 and the mating contact member 117. In the different embodiments of FIGS. 7-12, the functional section 111 comprises a pin 119 which is plugged in the mating plug receptacle 113. In FIGS. 7-12, the following types of pins 119 are shown: a solid pin 121; a square pin 123, which is a special variation of the solid pin 121; a compliant EON (end of needle) pin 125; an action pin 127; a multi-spring pin 129; and a contact spring pin 131. The functional section 111 may be provided independently on the embodiment of the contact member 1, i.e. also at IDC contact members not forming part of the present invention.

The functional section 111, in an embodiment, is monolithically connected with the bottom portion 22 and protrudes from a footprint 133 of the contact member 1. The footprint 133 is exemplarily shown by a shading 11 in FIG. 14 and may be applied accordingly to the other embodiments of the contact member 1 shown in FIGS. 7-16.

Figure 13:
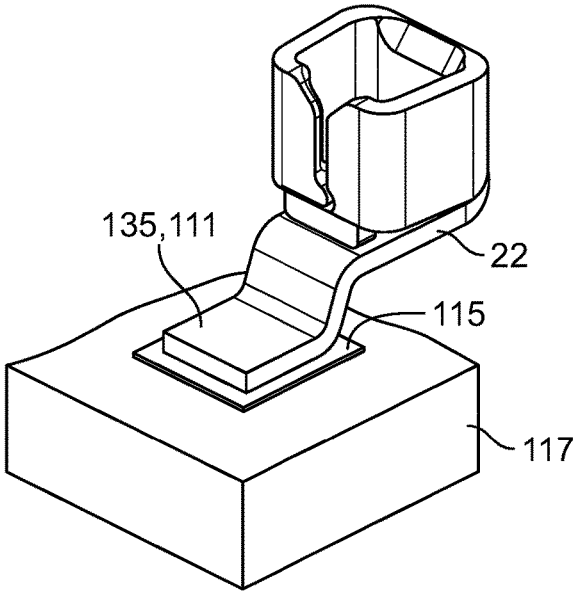
FIG. 13 is a top perspective view of a contact member assembly according to another embodiment.
Figure 14:
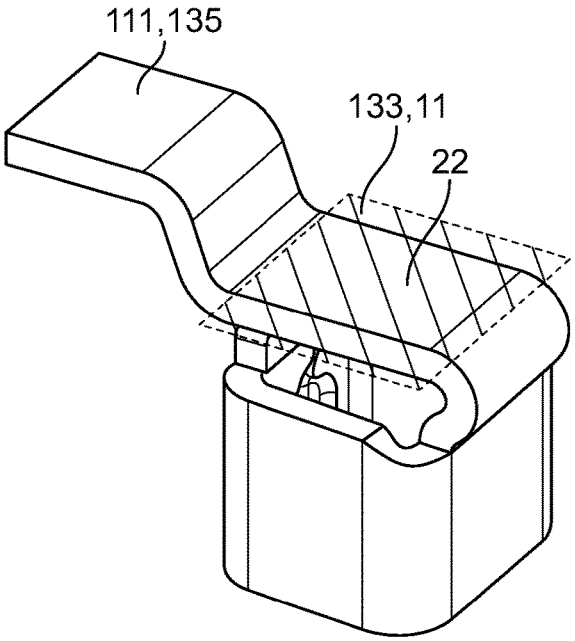
FIG. 14 is a bottom perspective view of the contact member assembly of FIG. 13.

In FIGS. 13 and 14, the functional section 111 has a plate section 135 which may either be soldered or welded to the mating contact section 115 or which may be simply pressed against the mating contact section 115. In the first two solutions, a fixed and permanent electrical connection is achieved, wherein in the third solution the (pressed) electric connection is releasable.

Figure 15:
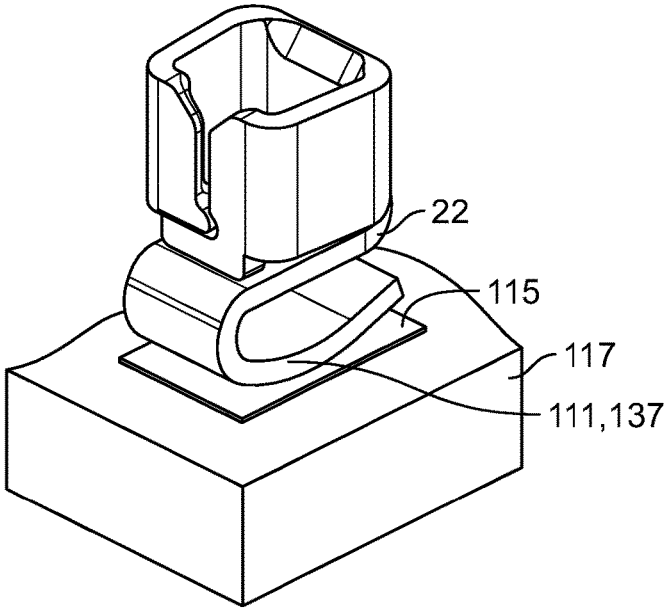
FIG. 15 is a top perspective view of a contact member assembly according to another embodiment.
Figure 16:
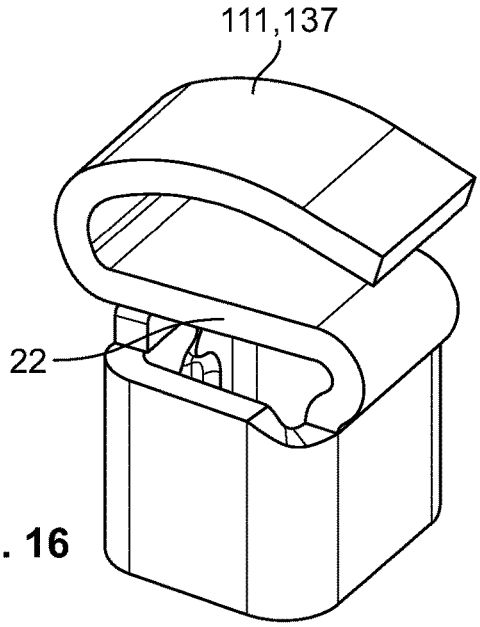
FIG. 16 is a bottom perspective view of the contact member assembly of FIG. 15.

In FIGS. 15 and 16, the functional section 111 has a spring element 137, and may be elastically pressed against the mating contact section 115 of the mating contact element 117. It is to be noted that the mating contact element 91 may be referred to as mating contact member 117 as well.

A set of contact members is to be understood as at least two contact members 1, wherein all contact members 1 of the set of contact members comprise a functional section 111. All of the contact members 1 or at least a sub-set of the contact members have differently structured functional sections 111. Such a set has the advantage that different application situations, in which a predetermined contact member 1 is desired, may be handled, wherein different modes of connecting the predetermined contact members, e.g. a pin connection in a first case and a welded connection in a second case, may be addressed by such a set.

Figure 17:
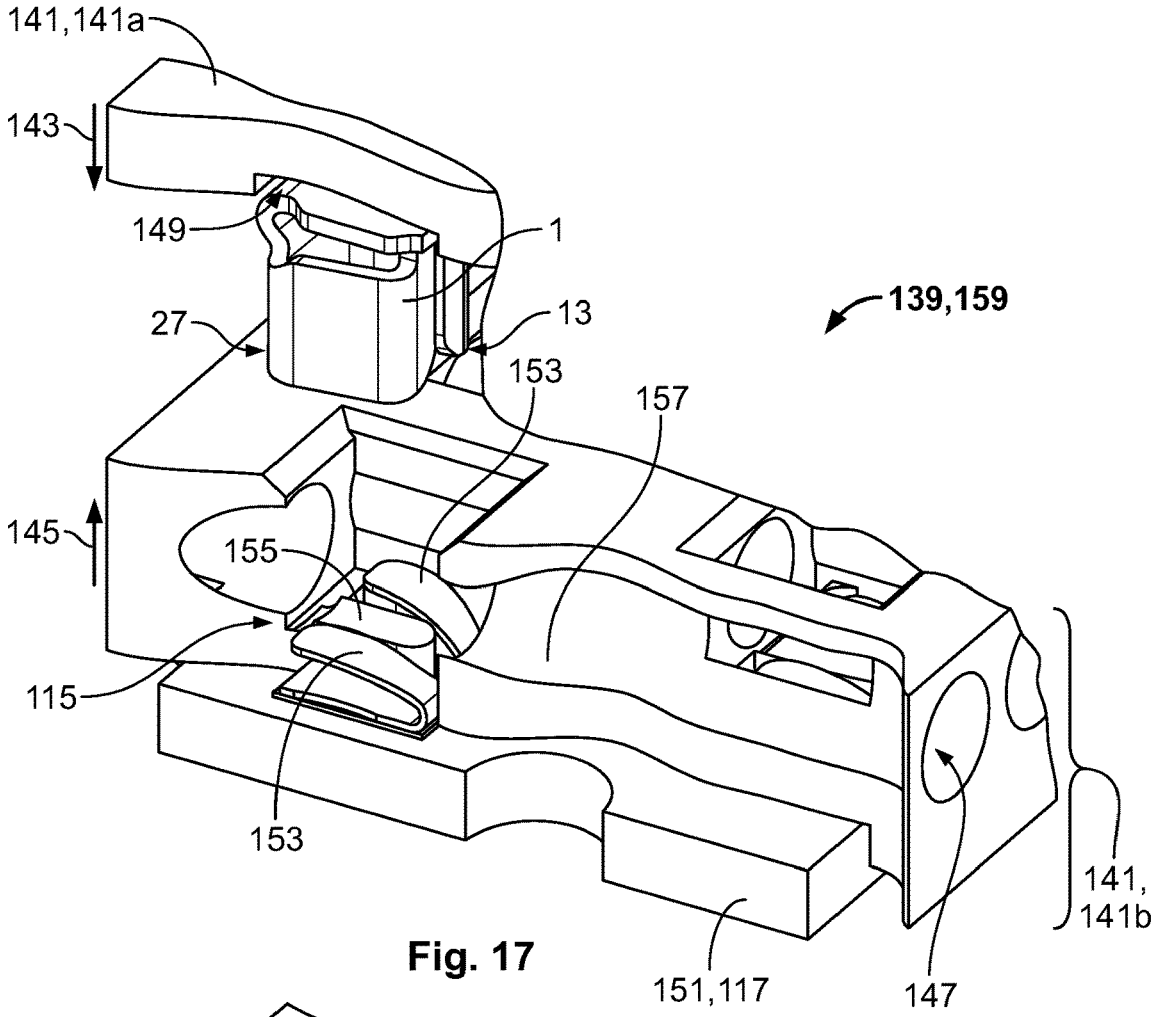
FIG. 17 is a sectional side view of a housing in an open state.
Figure 18:
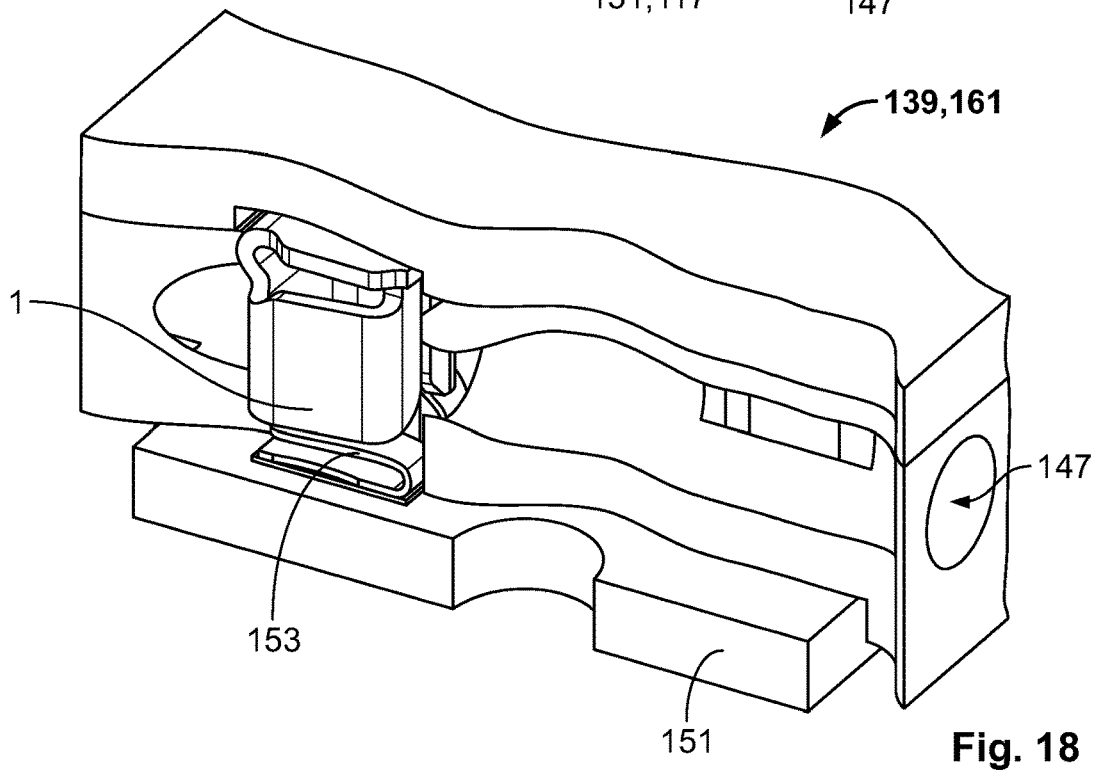
FIG. 18 is a sectional side view of the housing in a closed state.

A housing 139 according to an embodiment, as shown in FIGS. 17 and 18, comprises a pair of housing portions 141, which will be exemplarily distinguished by referring to them as an upper housing portion 141*a* and a lower housing portion 141*b*. Both housing portions 141 may be moved relatively to each other. The upper housing portion 141*a* is movable along a downward direction 143, whereas the lower housing portion 141*b* is movable along an upward direction 145.

The housing 139, as shown in FIGS. 17 and 18, has a cable or wire receptacle 147 into which a wire (not shown) may be inserted. The housing 139 further comprises a contact receptacle 149 in which a contact member 1 is received. In the embodiment of the housing 139 shown in FIGS. 17 and 18, the contact member 1 is a contact member 1 shown in FIG. 1-3. The contact member 1 is fixed in the contact receptacle 149 of the upper housing portion 141*a*. It may be reversibly removed and inserted into the contact receptacle 149. The cable or wire receptacle 147 corresponds to a tubular hollow structure, respectively a tubular receptacle but may have a different cross-section in different embodiments of the housing 139, in particular if cables or wires of a different cross-section are applied.

The lower housing portion 141*b*, as shown in FIG. 17, has a mating contact member 117, which may be a printed circuit board (PCB) 151, which comprises a mating contact section 115 having a plurality of mating contact springs 153. In between the mating contact springs 153, a support portion 155 is provided, which is aligned with the cable or wire receptacle 147, at least in portions if viewed along the extension of the cable or wire receptacle 147. If a wire is received in the cable or wire receptacle 147, it abuts an inside wall 157 of the cable or wire receptacle 147 as well as the support portion 155. The support portion 155 assures that in evenly distributed force may be applied onto the wire (not shown) during contacting the core of the wire with the contact member 1.

As shown in FIGS. 17 and 18, the contact member 1 is mounted to the upper housing portion 141*a* such that the IDC member 13 as well as the cutting blade 27 face towards the lower housing portion 141*b*. If the housing portions 141 are moved towards each other, the wire (not shown), which is supported by the inside wall 157 of the cable or wire receptacle 147 and by the support portion 155, is pressed onto the cutting blade 27 as well as into the IDC member 13. Thus, as described in FIG. 4-6, the wire is electrically contacted.

In an open state 159, shown in FIG. 17, a cable or wire may be inserted into the cable or wire receptacle 147. A closed state 161 is shown in FIG. 18. In the closed state 161, at least portions of the cable or wire receptacle 147 overlaps with the contact member 1. Further, in the closed state 161 the mating contact springs 153 abut the contact member 1, thereby establishing an electric connection with the contact member 1. Thus, if a cable is received in the cable or wire receptacle 147, the cable may be electrically connected with the PCB 151 via the contact member 1 and the mating contact springs 153.

Figure 19:
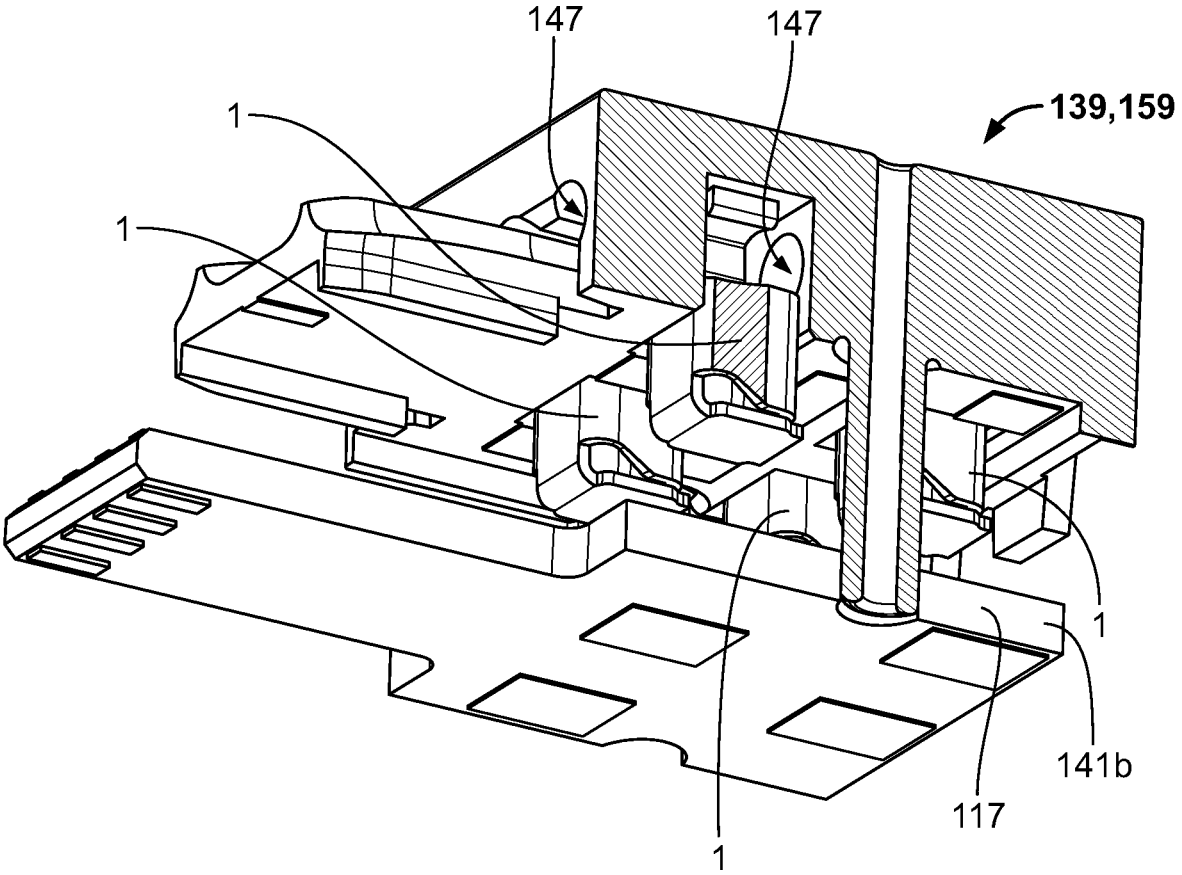
FIG. 19 is a sectional perspective view of a housing according to another embodiment in an open state.
Figure 20:
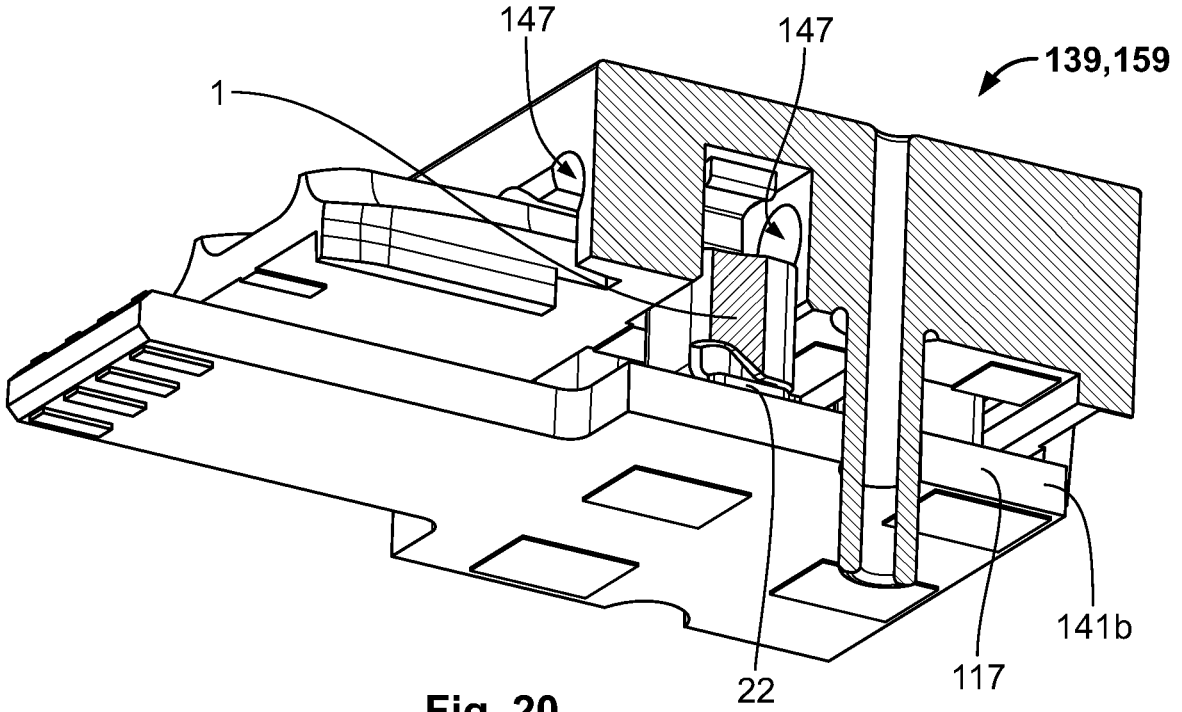
FIG. 20 is a sectional perspective view of a housing according to another embodiment in an open state.

Further embodiments of the housing 139, both in the open state 159, are shown in FIGS. 19 and 20. The cable or wire receptacle 147 is provided in the upper housing portion 141*a* and the mating contact member 117 is provided at the lower housing portion 141*b* or represents the lower housing portion 141*b*.

In the embodiment of FIG. 19, the contact member 1 (four are received) is adapted to be brought into abutment with the mating contact member 117. Thereby establishing the mechanical contact, also the electrical contact between the contact member 1 and the mating contact member 117 is established.

In the embodiment shown in FIG. 20, the contact member 1 is attached via the bottom portion 22 on the mating contact member 117. This mechanical connection may be a metallurgic connection, e.g. by welding or soldering.

In both FIGS. 19 and 20, the cable (not shown) is inserted from the right side into the cable or wire receptacle 147, wherein the residual piece of the wire (not shown) may be removed from the housing 139 on the left side.

Figure 21:
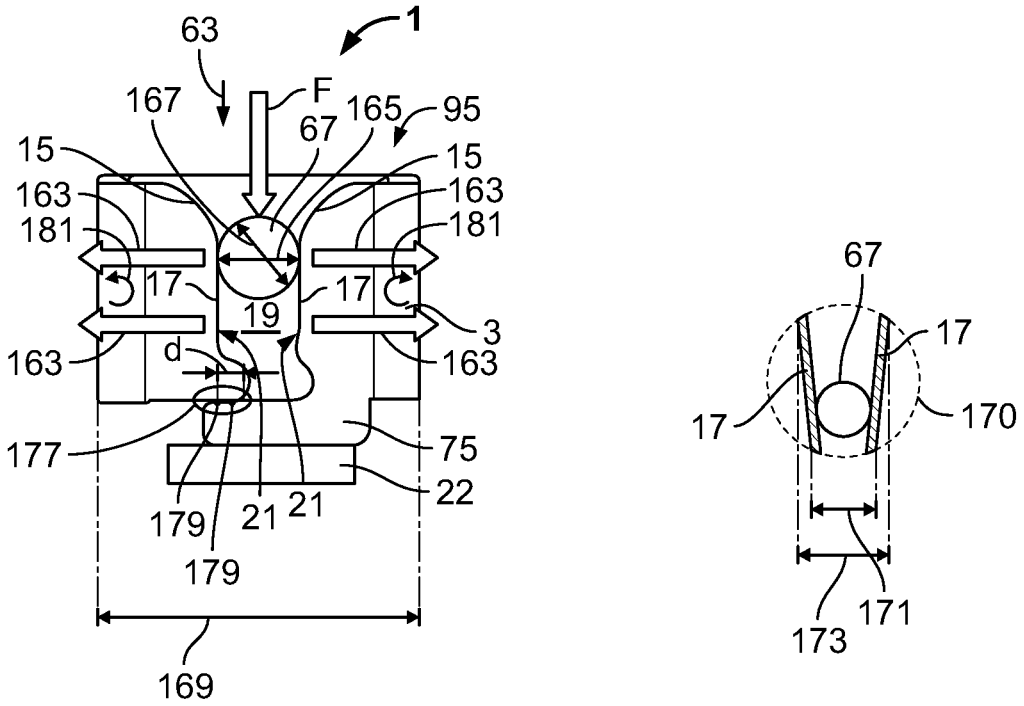
FIG. 21 is a front view of the contact member in a contacted state.
Figure 22:
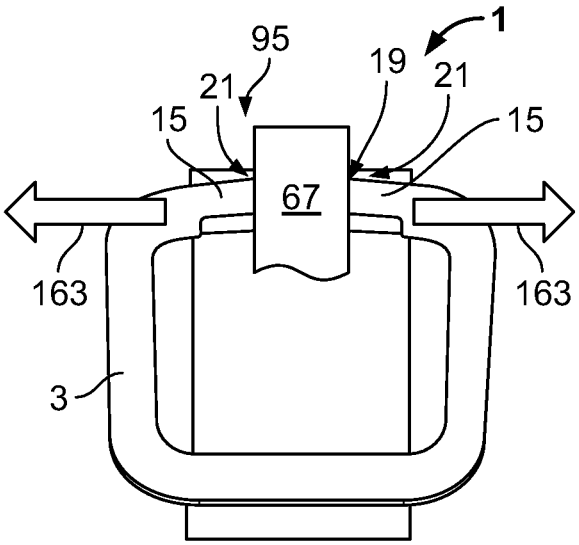
FIG. 22 is a top view of the contact member in the contacted state.

In FIGS. 21 and 22, the contact member 1 is shown in two different perspectives, a front view (FIG. 21) and an upper view (FIG. 22). Both figures show the contact member 1 in the contacted state 95, i.e. with a cable or wire 67 received in the slot 19 which is formed by two opposing IDC blades 15 and two opposing contact edges 17. It is noted that in different embodiments of the contact member 1 only one IDC blade 15 and one contact edge 17 may be provided; in this case, a counter pressing member opposes the one IDC blade 15 and the one contact edge 17.

In FIGS. 21 and 22, the cable or wire 67 does not have an insulation 69. When the force F is exerted onto the cable or wire 67, such that the cable or wire 67 is pressed along the insertion direction 63 into the slot 19, the end portions 21 of the encasement wall 3 are deflected along an deflection direction 163 which is directed away from the slot 19 and which is essentially parallel to the bottom portion 22. The deflection direction 163 is, in particular, the same for each portion of the corresponding end section 21. In other words, the IDC blade 15 of one end section 21 is moved or deflected along the same deflection direction 163 as the contact edge 17 of the same end section 21.

In the embodiment shown in FIG. 21, the contact edges 17 are parallel to each other (they may be oriented under an angle to each other in a different embodiment), wherein a deflected slot width 165 (which may approximately correspond to the wire diameter 167) is constant, at least along the contact edges 17.

In an embodiment in which the contact edges 17 are oriented with an angle to each other, the angle between the contact edges 17 is maintained. A deflected installation space 169 of the inventive contact member 1 may therefore be constant along the insertion direction 63. In a further circle 170 in FIG. 21, a contact member is schematically shown, wherein the contact edges 17 are deflected away from each other due to the cable or wire 67 received between them. At the position of the wire 67, a minimum deflection width 171 may be measured, which is different from a maximum deflection width 173 at the ends 175 of the contact edges 17. The required installation space of the inventive contact member 1 may, if compared to prior art solutions, consequently be smaller by a difference between the maximum deflection width 173 and the minimum deflection width 171.

FIGS. 21 and 22 show that the support member 75 provides a support section 177 in which one end section 21 (the end section 21 shown left in FIG. 21) abuts the support member of the other end section 21 (the end section 21 shown right in FIG. 21) in at least two support points 179, which are located at a distance d to each other. Exemplarily two support points 179 are shown. The support section 177 may be an area or a line. Due to the at least two support points 179, a torsional force 181 acting on each of the end portions 21 of the encasement wall 3 if a wire or cable 67 is received in the slot may thus be exerted onto the support member 75 and transformed into a deflection of the end sections 21 in the deflection direction, thereby inhibiting a torsional movement.

What is claimed is:

1. A contact member for an insulation displacement contact (IDC) terminal, comprising:

an encasement wall at least partially surrounding a receptacle volume receiving a wire or cable, the receptacle volume has an opening at least partially framed by the encasement wall;

a bottom portion disposed opposite the opening;

an IDC member having an IDC blade penetrating an insulation of the wire or cable, a contact edge electrically contacting a core of the wire or cable, and a slot extending from the IDC blade towards the bottom portion, the IDC member formed in a first wall section of the encasement wall;

a support member disposed between the first wall section and the bottom portion, the bottom portion, via the support member, provides a stop for the first wall section if a force is exerted onto the first wall section in a direction towards the bottom portion; and a cutting blade cutting the wire or cable, the cutting blade formed in a second wall section of the encasement wall opposite the first wall section, both the IDC blade and the cutting blade face the opening.

2. The contact member of claim 1, wherein the bottom portion is oriented essentially perpendicular to the encasement wall.

3. The contact member of claim 2, wherein the bottom portion is monolithically connected with the second wall section.

4. The contact member of claim 2, wherein the slot separates a pair of end portions of the encasement wall folded around the receptacle volume.

5. The contact member of claim 4, wherein at least a portion of the slot extends parallel to the bottom portion.

6. The contact member of claim 5, wherein the pair of end portions are linearly deflectable away from each other along a direction parallel to the bottom portion.

7. The contact member of claim 4, wherein the slot has a bent slot section between a section of the slot that is perpendicular to the bottom portion and a section of the slot that is parallel to the bottom portion.

8. The contact member of claim 7, wherein the bent slot section has an arc section that is bent away from the section of the slot that is perpendicular to the bottom portion.

9. The contact member of claim 8, wherein at the bent slot section, a protrusion of one end portion of the encasement wall is received in a complementary formed recess of the other end portion of the encasement wall, the protrusion and the recess engage in a form fit that blocks a relative movement of the pair of end sections forming the slot relative to each other in a direction perpendicular to the opening.

10. The contact member of claim 1, wherein the bottom portion is extended to form a functional section configured to be plugged in a mating plug receptacle and/or configured for being electrically connected to a mating contact section of a mating contact member.

11. The contact member of claim 10, wherein the functional section protrudes from a footprint of the contact member.

12. A contact member assembly, comprising:

a contact member including an encasement wall at least partially surrounding a receptacle volume receiving a wire or cable, the receptacle volume has an opening at least partially framed by the encasement wall, an IDC member having an IDC blade penetrating an insulation of the wire or cable and a contact edge electrically contacting a core of the wire or cable, the IDC member formed in a first wall section of the encasement wall, a cutting blade cutting the wire or cable, the cutting blade formed in a second wall section of the encasement wall opposite the first wall section, both the IDC blade and the cutting blade face the opening, and a bottom portion disposed opposite the opening and extending to form a functional section; and a mating contact element electrically connected to the contact member, wherein the functional section is at least one of a pin plugged in a mating plug receptacle of the mating contact element, or a spring element which is elastically pressed against a mating contact section of the mating contact element.

13. The contact member assembly of claim 12, wherein the bottom portion is oriented essentially perpendicular to the encasement wall.

14. The contact member assembly of claim 13, wherein the mating contact element is electrically connected to the functional section.

15. The contact member assembly of claim 14, wherein the functional section is a spring pin plugged in a mating plug receptacle of the mating contact element.

16. A contact member for an insulation displacement contact (DC) terminal, comprising:

an encasement wall at least partially surrounding a receptacle volume receiving a wire or cable, the receptacle volume has an opening at least partially framed by the encasement wall;

a bottom portion disposed opposite the opening;

an IDC member formed in a first wall section of the encasement wall and having an IDC blade penetrating an insulation of the wire or cable, a contact edge electrically contacting a core of the wire or cable, and a slot extending from the IDC blade towards the bottom portion and separating a pair of end portions of the encasement wall folded around the receptacle volume, the slot having a bent slot section between a section of the slot that is perpendicular to the bottom portion and a section of the slot that is parallel to the bottom portion, wherein at the bent slot section, a protrusion of one end portion of the encasement wall is received in a complementary formed recess of the other end portion of the encasement wall, the protrusion and the recess engage in a form fit that blocks a relative movement of the pair of end sections forming the slot relative to each other in a direction perpendicular to the opening; and a cutting blade cutting the wire or cable, the cutting blade formed in a second wall section of the encasement wall opposite the first wall section, both the IDC blade and the cutting blade facing the opening.

17. A contact member for an insulation displacement contact (IDC) terminal, comprising:

an encasement wall at least partially surrounding a receptacle volume receiving a wire or cable, the receptacle volume having an opening at least partially framed by the encasement wall, the encasement wall folded around the receptacle volume about a plurality of axes oriented perpendicularly with respect to a bottom portion of the terminal disposed opposite the opening;

an IDC member formed in a first wall section of the encasement wall and having an IDC blade penetrating an insulation of the wire or cable, a contact edge electrically contacting a core of the wire or cable, and a slot extending from the IDC blade towards the bottom portion and separating a pair of end portions of the encasement wall; and a cutting blade adapted to cut the wire or cable, the cutting blade formed in a second wall section of the encasement wall opposite the first wall section, the cutting blade including a cutting edge provided at an outer surface of the second wall section and a blade surface extending obliquely between the outer surface of the second wall section and an inner surface of the second wall section, both the IDC blade and the cutting blade face the opening.

18. The contact member of claim 17, wherein:

the encasement wall further defines a third wall section connecting the first and second walls sections, and a fourth wall section arranged opposite the third wall section and connecting the first and second walls sections;

the encasement wall is folded between the each of the wall sections about a respective one of the plurality of axes; and each of the first, second, third and fourth wall sections are oriented generally perpendicularly with respect to the bottom portion of the terminal.

19. The contact member of claim 17, further comprising a support member disposed between the first wall section and the bottom portion, the bottom portion, via the support member, provides a stop for the first wall section if a force is exerted onto the first wall section in a direction towards the bottom portion.

20. The contact member of claim 19, wherein the support member is formed by at least one of the end portions of the encasement wall.

* * * * *